US009656378B2

(12) United States Patent
Hartmann et al.

(10) Patent No.: US 9,656,378 B2
(45) Date of Patent: May 23, 2017

(54) MACHINE TOOL

(71) Applicant: Hilti Aktiengesellschaft, Schaan (LI)

(72) Inventors: Markus Hartmann, Mauerstetten (DE); Manfred Ludwig, Landsberg (DE); Franz Moessnang, Stadtbergen (DE)

(73) Assignee: Hilti Aktiengesellschaft, Schaan (LI)

( * ) Notice: Subject to any disclaimer, the term of this patent is extended or adjusted under 35 U.S.C. 154(b) by 449 days.

(21) Appl. No.: 14/473,187

(22) Filed: Aug. 29, 2014

(65) Prior Publication Data

US 2015/0060099 A1 Mar. 5, 2015

(30) Foreign Application Priority Data

Aug. 30, 2013 (EP) ..... 13182345

(51) Int. Cl.

| | |
|---|---|
| ***B23B 45/16*** | (2006.01) |
| ***B25D 9/00*** | (2006.01) |
| ***B25D 11/00*** | (2006.01) |
| ***B25D 13/00*** | (2006.01) |
| ***B25D 16/00*** | (2006.01) |
| ***B25D 17/24*** | (2006.01) |
| ***B25D 17/06*** | (2006.01) |
| ***B25D 11/04*** | (2006.01) |

(52) U.S. Cl.

CPC ..... *B25D 17/24* (2013.01); *B25D 11/04* (2013.01); *B25D 17/06* (2013.01); *B25D 2211/068* (2013.01); *B25D 2217/0019* (2013.01); *B25D 2222/57* (2013.01); *B25D 2250/345* (2013.01)

(58) Field of Classification Search

USPC ..... 173/206–210

See application file for complete search history.

(56) References Cited

U.S. PATENT DOCUMENTS

| | | | | |
|---|---|---|---|---|
| 5,050,687 | A * | 9/1991 | Prokhorov | B25D 9/04 173/104 |
| 5,379,848 | A | 1/1995 | Rauser | |
| 5,617,925 | A * | 4/1997 | Boothby | B25C 1/14 173/210 |
| 9,527,199 | B2 * | 12/2016 | Massler | B25D 11/06 |
| 2006/0076154 | A1 * | 4/2006 | Aoki | B25D 11/125 173/212 |
| 2010/0000752 | A1 * | 1/2010 | Kunz | B25C 1/14 173/211 |

(Continued)

FOREIGN PATENT DOCUMENTS

| | | | |
|---|---|---|---|
| EP | 0 663 270 | A1 | 7/1995 |
| EP | 1 602 451 | A2 | 12/2005 |

(Continued)

OTHER PUBLICATIONS

European Search Report dated Jan. 22, 2014, with Statement of Relevancy (Four (4) pages).

*Primary Examiner* — Robert Long

(74) *Attorney, Agent, or Firm* — Crowell & Moring LLP

(57) ABSTRACT

A machine tool is disclosed. The machine tool has a tool receptacle for receiving a tool on a working axis, a housing, and a striking mechanism. An impact stop is provided for a beater or an intermediate beater. An impact absorber has two polymer-based absorber rings that are offset axially to one another and are disposed so that they overlap radially and has two iron-based disks disposed axially between the absorber rings.

6 Claims, 1 Drawing Sheet

(56) References Cited

U.S. PATENT DOCUMENTS

| | | | | |
|---|---|---|---|---|
| 2010/0025061 | A1* | 2/2010 | Meixner | B25D 11/125 173/118 |
| 2012/0125650 | A1* | 5/2012 | Koch | B25D 17/24 173/211 |
| 2013/0220658 | A1* | 8/2013 | Ontl | B25D 16/003 173/211 |

FOREIGN PATENT DOCUMENTS

| | | | |
|---|---|---|---|
| EP | 2 199 030 | A1 | 6/2010 |
| JP | 2005-40880 | A | 2/2005 |

* cited by examiner

MACHINE TOOL

This application claims the priority of European Patent Document No. EP 13182345.2, filed Aug. 30, 2013, the disclosure of which is expressly incorporated by reference herein.

BACKGROUND AND SUMMARY OF THE INVENTION

The present invention relates to a machine tool with an impact absorber.

The machine tool according to the invention has a tool receptacle for receiving a tool on a working axis, a housing, and a striking mechanism. The striking mechanism has a motor-driven exciter, a beater, a pneumatic chamber between the exciter and beater which couples the movement of the exciter to the beater, and an intermediate beater. An impact stop is provided for the beater or the intermediate beater such that the impact stop is movable in the housing in a direction parallel to the working axis, preferably the beating direction. An impact absorber has two polymer-based absorber rings, disposed so that they overlap radially and are offset axially to one another, and two iron-based disks disposed axially between the absorber rings. A first one of the absorber rings is supported in the direction on the housing and the second one of the absorber rings is supported on the impact stop in the opposite direction. A first one of the disks is in contact with the first one of the absorber rings in the direction and is supported on the impact stop in the opposite direction. A second one of the disks is in contact with the second absorber ring in the opposite direction and is supported on the housing in the direction.

The design of the impact absorber is compact and can nevertheless absorb high loads. In particular this design has proven to be superior to that of an impact absorber with only one absorber ring, either with regard to the necessary dimensions of the absorber ring or the maximum load-bearing capacity.

The following description explains the invention on the basis of exemplary embodiments and figures.

DETAILED DESCRIPTION OF THE DRAWINGS

Figure 1:
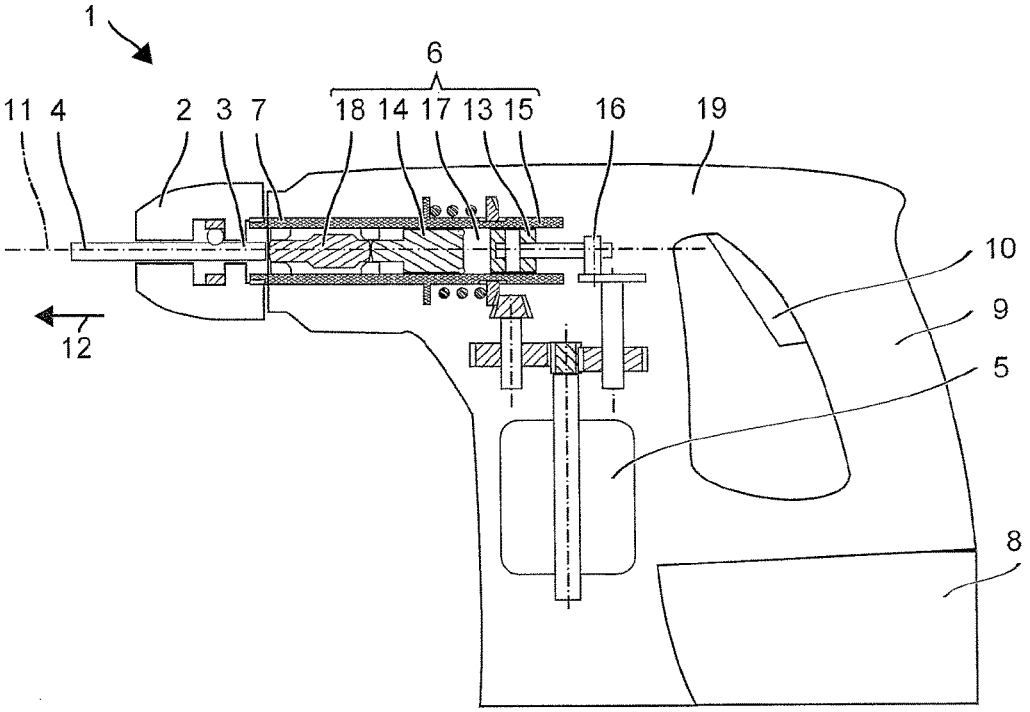
FIG. 1 shows a hammer drill in accordance with an embodiment of the present invention.
Figure 2:
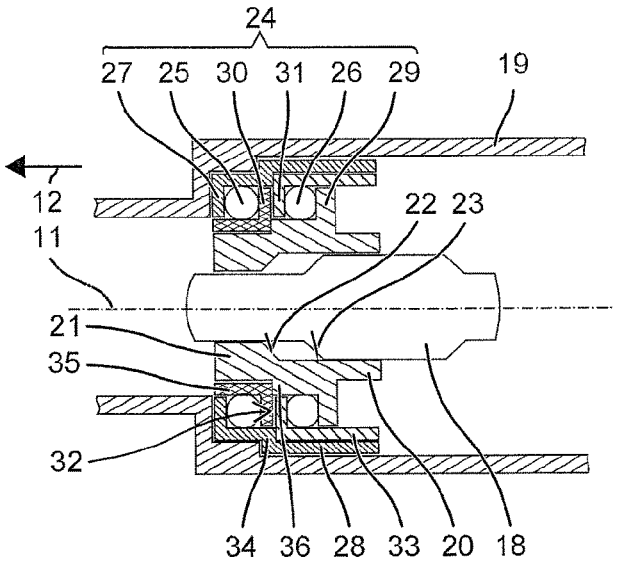
FIG. 2 shows a detail of the hammer drill of FIG. 1.

Unless otherwise indicated, the same elements or those having the same function are indicated by the same reference numerals in the Figures.

FIG. 1 shows schematically a hammer drill 1 as an example of a drilling, chiseling machine tool. The hammer drill 1 has a tool receptacle 2 into which a shaft end 3 of a tool, for example, a drill or a chisel 4 can be inserted. A motor 5, which drives a striking mechanism 6 and an output shaft 7, forms a primary drive of the hammer drill 1. Power can be supplied to the motor 5 from a battery pack 8. The user can guide the hammer drill 1 by a handle 9 and can operate the hammer drill 1 by a system switch 10. During operation, the hammer drill 1 causes the drill 4 to rotate continuously about a working axis 11 and can drive the drill 4 into the substrate in the beating direction 12 along the working axis 11.

The striking mechanism 6 is a pneumatic striking mechanism 6, for example. An exciter 13 and a feeder 14 are guided movably along the working axis 11 in a guide tube 15 of the striking mechanism 6. The exciter 13 is connected to the motor 5 by an eccentric cam 16 or a rotary finger and forced to execute a periodic linear movement. A pneumatic spring, formed by a pneumatic chamber 17 between the exciter 13 and the beater 14, couples a movement of the beater 14 to the movement of the exciter 13. The beater 14 strikes the drill 4 indirectly via an essentially stationary intermediate beater 18 in order to transfer a portion of its pulse to the drill 4. The striking mechanism 6 and preferably the additional drive components are disposed inside a machine housing 19.

The intermediate beater 18 (riveting die) is disposed in a guide 20 in which the intermediate beater 18 is movably guided coaxially with the working axis 11. An impact stop 21 limits the movement in the beating direction 12. The impact stop 21 has an impact surface 22, which overlaps radially with the intermediate beater 18. The intermediate beater 18 comes to lie with a radially protruding mating surface 23 on the impact surface 22 in the beating direction 12. The impact stop 21 is movably disposed within the housing 19 together with the guide 20.

When the intermediate beater 18 strikes the impact stop 21 in the case of a blank stroke, the impact stop 21 is shifted in the beating direction 12 with respect to the housing 19.

The impact stop 21 is connected to the housing 19 by an impact absorber 24. The impact absorber 24 contains two absorber rings 25, 26. The two absorber rings 25, 26 are disposed coaxially with the working axis 11 and surround the impact stop 21 and/or the guide 20. The two absorber rings 25, 26 are made of a synthetic rubber and can absorb an impact due to their elasticity. The two absorber rings 25, 26 are disposed with an offset relative to one another along the working axis 11 but they are at essentially the same height in the radial direction. The two absorber rings 25, 26 overlap in the radial direction; in the embodiment illustrated here the two absorber rings 25, 26 overlap with one another completely. The two absorber rings 25, 26 have approximately the same diameter, their diameters differing by less than their cord diameters.

The front absorber ring 25 is supported on the housing 19 in the beating direction 12. In the embodiment shown as an example, the front absorber ring 25 is in contact with a collar 27 of a sleeve 28 in the beating direction 12. The sleeve 28 is immovably in contact with the housing 19 in the beating direction 12. The rear absorber ring 26 is in contact with a stop 29 of the impact stop 21 against the beating direction 12. The stop 29 may be formed in one piece with the impact stop 21 or may be connected to the impact stop 21 by a spring ring, etc.

Two disks 30, 31 are disposed between the two absorber rings 25, 26. The two disks 30, 31 separate the two absorber rings 25, 26 from one another. The front disk 30 contacts the front absorber ring 25 with its side pointing in the beating direction 12. With its side facing away from the beating direction 12, the rear disk 31 contacts the rear absorber ring 26. The two disks 30, 31 do not come in contact with one another. The distance between the two disks 30, 31 is filled by an air gap 32. No coupling is provided between the two disks 30, 31. The front disk 30 is supported on the impact stop 21 against the beating direction 12. The front disk 30 as an example is in contact with the stop 29. The front disk 30 cannot move against the beating direction 12 with respect to the impact stop 21. The front disk 30 is inhibited from approaching the rear disk opposite the beating direction 12.

The rear disk 31 lies in the beating direction 12 and is supported on the housing 19 in the beating direction 12. Consequently, the rear disk 31 cannot be shifted in the beating direction 12 with respect to the housing 19. The rear disk 31 is prevented from approaching the front disk 30 in the beating direction 12.

The rear disk 31 is formed, for example, as a radially inwardly protruding collar of a sleeve 33. The rear absorber ring 26 is in contact with the collar in the beating direction 12 and therefore the disk 31 is also in contact, and in the radial direction it is in contact with the inside of the sleeve 33. The sleeve 33 is in contact with a step 34 of the housing 19 or the sleeve 28 in the beating direction 12. The front disk 30, for example, is designed as a collar of a sleeve 35 protruding radially outward. The front disk 30 is in contact with a step 36 of the impact stop 21 opposite the beating direction 12.

The axial distance between the two absorber rings 25, 26 is limited essentially to the disks 30, 31 and the air gap 32. The axially compact design ensures that the impact stroke will follow a short path of approximately the same length into the absorber rings 25, 26. It is advantageous in particular that the impact stroke must traverse at most one disk 30 between the impact stop 21 and the absorber ring 25. The internal loads on the impact absorber 24 due to scattering of the impact stroke at seams and interfaces is thus minimized.

In the case of an impact stroke of the intermediate beater 18 in the impact stop 21, the forces that occur are distributed to the two absorber rings 25, 26. The impact stroke is in part introduced into the housing 19 with the stop 29 of the impact stop 21 by the rear absorber ring 26 and the rear disk 31. The stop 29 transfers another portion onto the front disk 30 from which the other portion of the impact stroke passes through the front absorber ring 25 and is introduced into the housing 19. The two absorber rings 25, 26 are put under load at the same time, preferably with a force of the same size.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A machine tool, comprising:

a housing;

a tool receptacle coupled to the housing for receiving a tool on a working axis;

a striking mechanism disposed within the housing, wherein the striking mechanism includes a motor-driven exciter, a beater, a pneumatic chamber defined between the exciter and the beater which connects a movement of the exciter to the beater, and an intermediate beater;

an impact stop for the beater or the intermediate beater, wherein the impact stop is movable in a direction parallel to the working axis in the housing; and an impact absorber, wherein the impact absorber includes two polymer-based absorber rings that are axially offset relative to one another and are disposed in a radially overlapping manner and two iron-based disks that are disposed axially between the two absorber rings;

wherein a first one of the absorber rings is supported in the direction on the housing and a second one of the absorber rings is supported in an opposite direction to the direction on the impact stop;

wherein a first one of the iron-based disks is in contact with the first one of the absorber rings in the direction and is supported on the impact stop in the opposite direction to the direction;

and wherein a second one of the iron-based disks is in contact with the second one of the absorber rings in the opposite direction to the direction and is supported on the housing in the direction.

2. The machine tool according to claim 1, wherein the two absorber rings are identical in design.

3. The machine tool according to claim 1, wherein an air gap separates the two iron-based disks along the working axis.

4. The machine tool according to claim 3, wherein the second one of the iron-based disks is formed by a collar on a sleeve protruding radially inward.

5. The machine tool according to claim 1, wherein the intermediate beater is disposed downstream from the beater in the direction.

6. A machine tool, comprising:

a housing;

a tool receptacle coupled to the housing and defining a working axis;

a striking mechanism disposed within the housing, wherein the striking mechanism includes an exciter, a beater, a pneumatic chamber defined between the exciter and the beater, and an intermediate beater;

an impact stop engageable with the intermediate beater; and an impact absorber disposed between the impact stop and the housing, wherein the impact absorber includes two absorber rings that are axially offset relative to one another and are at a same height in a radial direction and two iron-based disks that are disposed axially between the two absorber rings.

* * * * *